United States Patent [19]

Fukushima et al.

[11] 4,206,257

[45] Jun. 3, 1980

[54] NAPPED SHEET MATERIAL BEARING THE CHARACTERISTICS OF A SUEDE-LEATHER AND METHOD OF PRODUCING THE SAME

[75] Inventors: Osamu Fukushima, Okayama; Koji Hoashi; Kunio Kogame, both of Kurashiki, all of Japan

[73] Assignee: Kuraray Co., Ltd., Kurashiki, Japan

[21] Appl. No.: 961,373

[22] Filed: Nov. 16, 1978

[30] Foreign Application Priority Data

Nov. 28, 1977 [JP] Japan ..... 52-143062

[51] Int. Cl.[2] ..... B32B 33/00

[52] U.S. Cl. ..... 428/91; 28/162; 28/168; 428/198; 428/288; 428/904

[58] Field of Search ..... 428/16, 91, 904, 198, 428/288; 28/162, 168

[56] References Cited

U.S. PATENT DOCUMENTS 3,932,687 1/1976 Okamoto et al. ..... 428/904

*Primary Examiner*—Marion McCamish

*Attorney, Agent, or Firm*—Barry Kramer

[57] ABSTRACT

A suede-like sheet material closely resembling natural leathers in feel and nap is produced by temporarily fixing a fibrous mat consisting of "oceano-insular" composite fibers, impregnating said fibrous mat with elastomer (A), smoothing the surface, impregnating the resulting mat with another elastomer (B) which is harder and less swellable than said elastomer (A), removing the sea or matrix component of the composite fiber, and napping the surface of the resulting sheet material.

17 Claims, No Drawings

NAPPED SHEET MATERIAL BEARING THE CHARACTERISTICS OF A SUEDE-LEATHER AND METHOD OF PRODUCING THE SAME

BACKGROUND OF THE INVENTION

1. Field of the Invention

This invention relates to a suede-like sheet material the substrate of which comprises a fibrous mat made of fibers that are bundles of finer fibers and two elastomers with which said fibrous mat is impregnated, said substrate having a nap on one side or on both sides thereof, and a method of producing the same.

2. Description of the Prior Art

A number of methods of producing a suede-like material having a nap resulting from finer-denier fibers have so far been proposed. For example, one method [method (a); cf. U.S. Pat. No. 3,706,613, British Pat. No. 1,241,382 German Pat. No. 1,901,209, French Pat. No. 2,000,223 and Canadian Pat. No. 910,140] comprises placing "oceano-insular" composite fibers in a fibrous mat such as a nonwoven fabric, said oceano-insular fibers each comprising a plurality of sectionally insular phases and a sectionally oceanic phase surrounding said insular phases, both of said insular and oceanic phases generally extending longitudinally along the fiber axis, and said oceano-insular fiber being produced by spinning of two or more polymers; temporarily fixing, or placing in a fixed state, said fibrous mat by treating the same with a sizing agent; removing said oceanic phase (so-called sea or matrix component); impregnating the mat with an elastomer; removing said sizing agent; and napping the surface of the resulting sheet material. Another method [method (b); cf. U.S. Pat. No. 3,424,604, British Pat. No. 1,094,064, German Pat. No. 1,469,550, French Pat. No. 1,420,623 and Canadian Pat. No. 789,966] comprises impregnating a fibrous mat prepared as in method (a) with an elastomer; removing the sea component; and napping the surface of the resulting sheet material. A further method [method (c); cf. Japanese Patent Application laid open under No. Sho-51-75178] comprises impregnating a fibrous mat prepared as in method (a) with an elastomer; removing the sea component; and reimpregnating the mat with an elastomer. However, the touch or feel of the sheet material produced by method (a) or (c) is far from those of a genuine suede of natural origin, because the elastomer invades the spaces formed after the removal of the sea component and produces a rubber-like touch or feel, that is a too high elasticity. On the other hand, the products made by method (b) are hardly balanced between surface characteristics, such as appearance of the nap and touch, and substrate characteristics, such as feel, drapability and sewability. Thus, if stress is laid on nap appearance, feel will be damaged and elasticity increased, while surface characteristics such as nap appearance will be inferior, if a serious view is taken of feel and sewability. These tendencies are also found in case method (a) or (c) is employed: thus, nap appearance is deteriorated, when the elastomer is varied so as to reduce the rubber-like touch and feel. Therefore, products with balanced surface and substrate characteristics can be produced only in a very narrow range of process conditions, and strict control of such conditions is required for a commercial production. As a result, production of a variety of suede-like sheet materials is quite difficult, and moreover production of suede-like sheet materials with satisfactory characteristics is also difficult.

SUMMARY OF THE INVENTION

An object of the invention is to provide a suede-like sheet material not only very closely resembling a genuine, natural suede leather in substrate characteristics, namely having a sufficient mechanical strength, being soft, having a feel with leather-like flexibility, a leather-like drapability and a good sewability, but also excellent in surface characteristics such as nap appearance and touch, as well as a method of producing the same.

Thus, the invention provides a suede-like sheet material characterized in that it comprises a fibrous mat made of fibers that are each a bundle of fine-denier fibers of not more than 0.3 denier and two polymers, polymer A and polymer B, with which said fibrous mat is impregnated, and has a nap resulting from said fine-denier fibers on one side or on both sides, said bundle of fine-denier fibers being prepared by removing the sea component of an oceano-insular fiber by extraction with a solvent or by decomposition with a decomposing agent, said polymer A being an elastomer with a degree of swelling (weight gain) in said solvent or decomposing agent at a temperature of 30° C. of not less than 30% by weight and an initial Young's modulus as measured in the form of a non-porous film of not more than 10 $kg/mm^2$, said polymer B being an elastomer with a degree of swelling not more than two thirds of that of polymer A and an initial Young's modulus as measured in the form of a non-porous film greater than that of polymer A by at least 0.2 $kg/mm^2$, said polymer A being present in said sheet material so as to partially stick to said bundle of fine fibers and primarily surround said bundle, said polymer B being present for the most part in the neighborhood of polymer A and in the spaces among the fiber bundles, either of said polymer A and said polymer B being substantially absent in the space portions resulting from the removal of said sea component.

The invention also provides a method of producing a suede-like sheet material having characteristics of a suede leather together with a napping resulting from bundles of a large number of fine-denier fibers on the surface of the substrate sheet comprising a fibrous mat impregnated with polymers each of which consists mainly of an elastomer, which method comprises carrying out in order the steps of:

(a) making a fibrous mat mainly composed of oceano-insular fibers each consisting of at least two polymeric materials different in properties from each other, at least one of said polymeric materials being present in said fibers as sea component and at least one other polymeric material being present, when viewed sectionally, scatteredly like islets in said fibers as islet component so that said fibers each can afford a number of fine-denier fibers in the product;

(b) impregnating said fibrous mat with a dispersion and/or solution of elastic polymer A, before or after temporarily fixing the fibers of said fibrous mat, and coagulating or solidifying said polymer A;

(c) in case the impregnation with polymer A is carried out before temporary fixation of the fibers or in case the temporary fixation is not enough, temporarily fixing the fibers, (d) in case the surface to be napped later is not sufficiently smooth, smoothing said surface by means of a press or a calender;

(e) impregnating said fibrous mat with a solution and/or dispersion of polymer B, which is mainly composed of an elastomer, and coagulating or solidifying polymer B;
(f) in case a sizing agent is used for the temporary fixation, removing the sizing agent;
(g) wholly or partly removing the sea component constituting the fibers by dissolving or decomposing the sea component so that each oceano-insular fiber can turn into a bundle of fine-denier fibers;
(h) napping the dried sheet materal on one side or on both sides, to produce a napped surface; and
(i) carrying out a necessary finishing treatment such as coloring and softening.

DETAILED DESCRIPTION OF THE INVENTION

A primary feature of the invention consists in that the relationship between polymer A to be contained in the fibrous mat and the fibers is different from the relationship between polymer B and the fibers. Thus, polymer A is distributed primarily at the points of crossing of fibers and in the neighborhood thereof and serves as a binder for partially setting or fixing fibers to each other, while polymer B is distributed primarily in the spaces among fibers and around polymer A, is sticking to fibers only to a small extent, and serves as a so-called filler. By such use of a polymer serving as binder and a different polymer serving as filler, an appropriate balance can easily be attained between substrate characteristics, such as feel and drapability, and surface characteristics, such as nap appearance and touch, in the suede-like sheet material produced.

Another feature of the invention is that substantially no elastomer is present in the spaces resulting from the removal of the sea component originally constituting the oceano-insular fibers, so that the rubber-like feel is decreased to an appropriate extent and as a result the product very closely resembles a genuine suede leather.

Features of the method of production according to the invention include not only the fact that said method can produce a suede-like sheet material resembling a natural leather very closely and well-balanced between substrate characteristics and surface characteristics, as mentioned above, but also the fact that it gives a suede-like sheet material with a high nap density and a high nap strength. That is to say, in accordance with the invention, a step of smoothing the surface on at least one side of the fibrous mat or sheet by means of a press or a calender is employed prior to the step of impregnation with polymer B, so that a high nap density and a high nap strength can be realized. Said smoothing by means of a press or a calender consists in pressing the sheet between flat plates or a pair of rolls or bringing the sheet into contact with a cylindrical surface with a tension exerted on the sheet. In this case, it is recommended that said surface smoothing should not increase the apparent density throughout the fibrous mat but increase such density only in the superficial portion of the mat. For this purpose, it is preferred to press the sheet with only the surface thereof heated or to contact the sheet with a cylindrical surface with only the surface thereof heated. As a result of such smoothing under pressure a remarkably improved napping effect, a higher nap density, a higher nap strength and a better flexibility can be attained in comparison with the cases lacking this step. An accompanying effect brought about by the smoothing step is that a desirably napped surface can be produced without so much buffing or nap raising as in the conventional methods. Any surface smoothing without pressure, such as buffing or slicing, cannot be a substitute for the surface smoothening to be carried out according to the invention. Smoothing by buffing or slicing contributes only to smoothness of the product surface but hardly contributes to improvement in napping effect such as attainable according to the invention. If the surface smoothing is carried out after the step of impregnation with and coagulation of polymer B, the effect of the smoothing will still be unsatisfactory, though a certain effect may be obtained.

The order of the steps is one of the features of the invention. The order of the steps of providing the fibrous mat with polymer A, providing the same with polymer B, removing the sea component of the oceano-insular fiber and napping is very important. With an other order than that specified herein, such an excellent suede-like sheet material as aimed at by the invention cannot be produced. Moreover, it is essential that the steps of temporary fixation of the fibers constituting the fibrous mat and of smoothing of the fibrous mat surface should be done prior to provision of polymer B. If a sizing agent is used for temporarily fixing the fibers, the sizing agent has to be removed after provision of polymer B.

The fiber constituting the fibrous mat to be used according to the invention in an oceano-insular fiber composed of at least two polymers with different properties, at least one polymer occurring as the sea component (or matrix component) and at least one remaining polymer being present scatteredly like a number of islets in the sea component, said islets forming a number of fine-denier fibers in the final product. Such a fiber can be prepared, for example, according to the following method.

At least two polymers are melted in different melting systems and the melts are spun while forming mixed streams by control of spinnerets according to the so-called composite spinning method, whereby oceano-insular fibers are prepared. Alternately, oceano-insular fibers are prepared according to the so-called mixed spinning method by mixing and melting two or more different polmers or by melting them in different melting systems and combining streams of polymer melts, and then spinning the resulting mixed stream of the polymers.

Polymers usable for producing oceano-insular fibers are, for example, polyethylene terephthalate, polydiethylene terephthalate, polyethylene isophthalate, copolycondensation product from terephthalic acid, another dicarboxylic acid and a diol, other spinnable polyesters, 6-nylon, 66-nylon, 610-nylon, 8-nylon, 109-nylon, 1010-nylon, 11-nylon, other spinnable polyamides and copolyamides, polyethylene, polypropylene, polybutylene, polypentene, other polyolefins, polyacrylonitrile, polyvinyl alcohol, polymers essentially derived from vinyl chloride, cellulose derivatives, polystyrene, poly-alpha-methylstyrene, chlorinated polystyrene, polyvinylnaphthalene, other polymers of vinyl-containing cyclic compounds, polyethers, polyurethane(urea)s, and other spinnable polymers. The polymer for constituting fine-denier fibers and the polymer to be used as a sea component may be selected from among the above-mentioned polymers depending upon the properties required of the final product. Examples of the combination of a fine-denier fiber constituting polymer, a sea component polymer and a solvent or decomposing agent for the sea component polymer are:

Polyethylene terephthalate-nylon (solvent: benzyl alcohol or calcium chloride-containing methanol),
6-Nylon-polyvinyl alcohol (solvent: water)
Polyethylene terephthalate-polyethylene (solvent: xylene),
Polypropylene-polystyrene (solvent: trichloroethylene),
6-Nylon-polyurethane (solvent: dimethylformamide),
Polyacrylonitrile-polystyrene (solvent: toluene),
6-Nylon-polyethylene (solvent: trichloroethylene), and
6-Nylon-polyester (decomposing agent: alkali).

The oceano-insular fibers may be subjected to draft, crimping or cutting, if necessary. The fineness of the oceano-insular fiber forming a fibrous mat is in the range between about one and about 20 deniers, preferably in the range of 1.5 to 15 deniers. If the fineness of the oceano-insular fiber is too small, difficulties will arise in commercial production of the fibrous mat. Moreover, when the fineness of the oceano-insular fiber is small and the number of fine-denier fibers per oceano-insular fiber is large, nap appearance and physical properties of the surface of the product tend to decrease. On the other hand, if the fineness of the oceano-insular fiber is too great, the commercial production of the fibrous mat will become difficult.

The fineness of the oceano-insular fiber may preferably be selected depending upon the fineness of the fine-denier fiber component to be used and the number of fine-denier fibers contained in each oceano-insular fiber. The fineness and the number of the fine-denier fibers may vary according to the product that is aimed at. For example, in case a calf-suede-like product or a nubuck-like product is to be made, it is preferable that the fineness is small and the number is large, concretely in the range of several hundred to 3000. In case a chamois or antelope buckskin-like product is to be made, it is preferable that the fineness is large and the number is small, concretely in the range of about 10 to about 100. When a sheep or goat suede-like product is desired, a fineness and a number respectively intermediate between those mentioned above are employed. In any case, however, the fineness of the fine-denier fibers is preferably selected in the range between about 0.3 and about 0.0005 denier, and the number of fine-denier fibers contained in one oceano-insular fiber in the range between about 10 and about 5000. The fine-denier fibers in the oceano-insular fiber do not always need to have one and the same fineness, but may be a mixture of fine-denier fibers different in fineness. The fineness of the oceano-insular fiber is selected depending upon the objective product so that the desired fineness and number of the fine-denier fibers may result.

The fibrous mat to be used according to the invention is, for example, a woven cloth, a knitted cloth or a nonwoven fabric. It may be shrunked or raised, if necessary. It may be used alone or in the form of a laminate. When the fibrous mat is a woven cloth or a knitted cloth, it is preferable to subject the cloth to a raising or napping treatment beforehand. When a nonwoven fabric is used as fibrous mat, it is preferred that said nonwoven fabric is a three-dimensionally entangled fiber mat prepared by collecting staple fibers or filaments, if necessary followed by entangling treatment and/or shrinking. The most preferable fibrous mat in practising the invention is the three-dimensionally entangled, nonwoven fabric mentioned above. Generally, the fibrous mat is so prepared that is has a weight of 150 to 4000, preferably 200 to 3,000 grams per square meter.

The fibers in the fibrous mat have to be temporarily fixed before or after the impregnation with polymer A. In case an easily weldable polymer is used as the sea component of the oceano-insular fiber, mere heat treatment may produce temporary fixation of fibers. In case the amount of such weldable polymer is insufficient or in case the sea component is a hardly weldable polymer, however, temporary fixation cannot be produced by mere heating, and therefore a sizing agent is used for that purpose. Generally, the sizing agent is used in an amount of about 3 to 20% by weight based on the fibrous mat. Water-soluble, high molecular weight substances such as starch, polyvinyl alcohol and carboxymethylcellulose are generally used as sizing agents.

In practising the method of the invention, it is essential that the surface of the fibrous mat is smoothed by a press or a calender prior to the impregnation with polymer B. In case a press or a calender is used in temporarily fixing fibers in the mat by heating or with a sizing agent or in coagulating polymer A under heating, the surface of the fibrous mat is smoothed on such occasion, and therefore it is not always necessary to treat said surface by means of a press or a calender again. The surface-smoothing treatment of the fibrous mat with a press or a calender may also be carried out between the step of temporarily fixing the fibers and the step of impregnating the mat with polymer B. In that case, however, if the surface of the fibrous mat before impregnation with polymer B is not smooth, it is necessary to smoothen said surface by means of a press or a calender prior to impregnation with polymer B.

Polymer A with which the fibrous mat is impregnated is an elastomer with a degree of swelling (weight gain) at a temperature of 30° C. in the solvent or decomposing agent used for dissolving or decomposing the sea component of the oceano-insular fiber of not less than 30%, preferably not less than 50% by weight, the loss (portion dissolved) of polymer A in said solvent or decomposing agent preferably being not more than 20%, usually not more than 10%. Such a polymer as shows, in a sectional view magnified 300 times of a mass thereof existing in the final product, a percentage of the total area of distinctly recognizable pores to the total sectional area of not more than 40%, preferably a substantially nonporous polymer, is suitable as polymer A. In addition, it is preferred that the polymer to be used as polymer A shows an apparent density of not less than 0.60 g/cm$^3$ when determined on a film formed under the same conditions and treated with the same solvent or decomposing agent as in the manufacture of the objective suede-like sheet material. Furthermore, polymer A should be a flexible polymer; the initial Young's modulus of a nonporous film made of polymer A should be not more than 10 kg/mm$^2$, preferably not more than 5 kg/mm$^2$, and more preferably not more than 2 kg/mm$^2$. If a polymer with a degree of swelling of less than 30% by weight is used as polymer A, the nap-raisability of the product will not be satisfactory, while a polymer with an initial Young's modulus of more than 10 kg/mm$^2$ will produce a hard feeling: in either case, sheet materials resembling natural leathers cannot be obtained.

Polymer B to be used in accordance with the invention is an elastomer whose degree of swelling or weight gain in the above-mentioned solvent or decomposing agent at a temperature of 30° C. is not more than two thirds of that of polymer A and usually not more than 100% by weight. It is preferred that, when a section of a mass of polymer B existing in the final product is observed at 300 magnification, the percentage of the total area of distinctly recognizable pores to the total sectional area is not less than 30%, especially not less than 50%: a so-called porous polymer is preferred as polymer B. The initial Young's modulus of a nonporous film made of polymer B should be higher than that of polymer A by at least 0.2 kg/mm$^2$, preferably by at least 0.5 kg/mm$^2$. That is, a polymer harder than polymer A is used as polymer B. When the degree of swelling (weight gain) of polymer B exceeds two thirds of that of polymer A, the resulting sheet material feels elastic and like rubber, and when the initial Young's modulus of polymer B does not reach the sum of the initial Young's modulus of polymer A and 0.2 kg/mm$^2$, the resulting sheet material feels too hard; in both these cases, sheet materials resembling natural leathers cannot be produced.

In accordance with the invention, it is essential that polymer A and polymer B should be present in the product sheet material each separately or, in other words, in an unmixed state. It is preferable for this purpose that either the solvent for polymer A is different from that for polymer B or polymer A and polymer B are different in solubility. It does not matter that polymer A is partially dissolved in the solvent in the step of impregnation with polymer B, if the dissolved portion of polymer A does not enter the polymer B portion until coagulation of polymer B is complete, so that polymer A portions are distinguishable from polymer B portions, or if both the polymers are incompatible each other so as to cause phase separation. Examples of suitable polymer A-polymer B-solvent systems are:

- Polyurethane derived from polyethylene glycol-polyurethane derived from polytetramethylene glycol-dimethylformamide;
- Polyurethane derived from polytetramethylene glycol-polyurethane derived from polybutylene adipate-dimethyl-formamide;
- Polyacrylate ester-polyurethane derived from polyethylene adipate or polyurethane derived from polytetramethylene glycol-dimethylformamide;
- Polyurethane derived from polyester diol or polyether diol as soft segment, with diamine as chain extender-polyurethane derived from polyester diol or polyether diol as soft segment, with diol as chain extender-dimethylformamide; and
- Polyurethane with higher soft segment content-polyurethane with lower soft segment content-dimethylformamide.

The elastomer that constitutes the main part of polymer A to be used in practising the invention may be of any kind, so far as it meets the conditions mentioned above. Said elastomer is, for example, polyacrylate ester, acrylate ester copolymer, acrylonitrile-butadiene copolymer, styrene-butadiene copolymer, polyisoprene, isoprene-butadiene copolymer, other synthetic rubber, modified synthetic rubber, polyurethane (urea)elastomer prepared by polymerization of polymer diol and organic polyisocynanate together with chain extender compound having two active hydrogen atoms, or polyester elastomer prepared by polymerization of polymer diol, ring-containing compound having two hydroxyl groups and phosgene. These elastomers may be used alone or in combination of two or more of these. Polymer A may contain other polymers than these, as far as said other polymers do not cause marked decrease in elasticity of polymer A. Polymer A is used in impregnation in the form of a dispersion such as emulsion or slurry, or in the form of a solution or a solution containing another polymer dispersed therein. It is especially effective to use an aqueous dispersion with decreased surface tension and viscosity so as to penetrate the narrow spaces within the fibrous mat sufficiently.

The elastomer which constitutes the main part of polymer B may be of any kind, so far as it satisfies the above-mentioned requirements. Such elastomer is, for example, a polyurethane(urea) elastomer prepared by polymerization of one or more polymer diols selected from among polyester diol, polyether diol and polyester-polyether diol, and an organic diisocyanate together with a chain extender compound having two active hydrogen atoms, said polyurethane(urea) elastomer preferably having a hard segment content in the range of about 30% to about 70% by weight, more preferably in the range of about 35% to about 65% by weight. Other polymers usable as polymer B include polymers and copolymers of acrylic esters, melamine- or formaldehyde-modified polymers and copolymers of acrylic esters, modified or unmodified acrylonitrile-butadiene copolymers, modified or unmodified polymers and copolymers of butadiene and other synthetic rubbers, natural rubbers, polyester elastomers prepared by reaction of a polymer glycol and a cyclic compound having two hydroxyl groups together with a chain extender such as phosgene, polyamides and modified polyamides. These may be used alone or in combination of two or more of these, and further polymer B may contain other polymers than these, as far as said other polymers do not cause marked decrease in elasticity of polymer B. Polymer B is used in the impregnation step in the form of a dispersion such as emulsion or slurry, or in the form of a solution or a solution containing another polymer dispersed therein. In cases where polymer B is desired to be porous in the final product, the use of an additive or additives such as an agent for controlling the pores which form on coagulation of polymer B, a pore-forming agent, a foaming agent, and a pore-stabilizing agent. When polymer B is hard, a plasticizer may be used.

Coagulation or solidification of polymer A and of polymer B may be effected, for instance, by treatment of the solution of the polymer with a nonsolvent for the polymer, by treatment in a reversely ionic coagulating liquid if the polymer is ionic, by heating, and/or evaporation of the solvent or dispersing agent in an inert atmosphere.

The amount of polymer A and of polymer B to be contained in the fibrous mat is such that the total amount of all the polymers contained in the product is about 10 to about 150%, preferably about 15 to about 100% by weight based on the fiber weight. If the polymer amount is insufficient, resilience of the nap is lost and falling out of the nap results, although the nap is bulky and long. If the polymer amount is excessive, not only the nap is thin and short and no longer capable of giving a suede-like appearance, but also balancing cannot be achieved between the fiber resilience and the polymer resilience; these tendencies are unfavorable to feel and sewability.

The optimal weight ratio of polymer A to polymer B in the product depends on the Young's modulus and the degree of swelling each of polymer A and polymer B.

Generally, when the total amount of polymers does not exceed about 50% by weight based on the weight of fibers in the product, it is preferable that the amount of polymer A is not less than about 5%, more preferably not less than 10%, of the total polymer amount. When the total polymer amount is about 80% or more, it is preferable that the amount of polymer A does not exceed about 60% of the total polymer content. When the total polymer amount is 50 to 80% against the fiber, the amount of polymer A is preferably in the range of 5 to 95% of the total polymer content. In any case, however, strictly speaking, this ratio should preferably be determined by experiments, considering the desired characteristics of the product as well as the productivity respects such as extractability of the sea component of the fiber and raisability.

In case polymer A and polymer B are used both in the form of solution, it is preferable that the solvents are different. By saying herein that the solvents are different, the case is also included where the same solvent is used for both the polymers but a nonsolvent for polymer A is added to the solvent system for polymer B in such an amount that polymer B does not precipitate yet and a decreased solubility of polymer A in the solvent system results.

In case a sizing agent is used for temporary fixation of fibers, the sizing agent is removed from the sheet after impregnation with and coagulation of polymer B. Since usually a water soluble macromolecular substance is used as the sizing agent, it is easily removed by washing the sheet with water.

In case the substrate fibrous mat is a three-dimensionally entangled, nonwoven fabric, the sheet after impregnation with and coagulation of polymer B may be split or sliced into two in the direction of the thickness.

The smoothed surface of the so-prepared sheet is napped, for example by buffing with a sandpaper or the like. In accordance with the invention, the napping is limited to a very superficial portion, namely to the depth of not more than 0.2 mm, whereby a maximum effect of the invention is produced.

The subsequent finishing treatments necessary to make a suede-like sheet material, such as coloration, softening and brushing, give an excellent suede-like sheet material that the invention has for its aim.

The following examples will illustrate several modes of practising the invention. The invention, however, is not limited to these examples. In the examples, "parts" and "%" are, unless otherwise stated, on a weight basis.

EXAMPLE 1

A polyethylene-nylon oceano-insular fiber comprising 50 parts of polyethylene as sea component and 50 parts of 6-nylon as islet component constituting about 350 fine-denier fibers was drawn in hot water to make a 4.5-denier fiber. This fiber was crimped and cut into a staple, from which a needle-punched, entangled nonwoven fabric weighing about 800 grams per square meter (apparent density: 0.19 g/cm$^3$) was prepared. This entangled nonwoven fabric was impregnated with a 5% aqueous dispersion of a butyl acrylate resin of the self-curing type (polymer A), then squeezed so that the fabric contained the dispersion in an amount of about 50% by weight based on the fabric, and dried in a hot air drier at a temperature of 130° C. The drying caused at the same time temporary fixation of the fabric due to welding. The surface of the fabric was smoothed by pressing the fabric, while still hot, by means of a pair of hot rolls at a temperature of 90° C., with a clearance adjusted, at a press cylinder pressure of 0.3 kg/cm$^2$. The apparent density of the resulting, temporarily fixed, entangled nonwoven fabric was 0.36 g/cm$^3$. A film separately made of polymer A had a degree of swelling as measured in toluene of about 240%, an initial Young's modulus of 0.05 kg/mm$^2$, and a loss in toluene of about 2.7%.

The temporarily fixed, entangled nonwoven fabric was then impregnated with a 13% solution in dimethylformamide (hereinafter DMF) of a polyurethane elastomer (polymer B) prepared by reaction of polyethylene adipate, diphenylmethanediisocyanate and ethylene glycol, which solution contained a coagulation regulator. After an amount of polymer B of about 185 g/m$^2$ was attained, the fabric was treated in a 30% DMF solution in water to cause coagulation, washed with water and extracted with hot toluene to remove the sea component of the fiber. The initial Young's modulus of polymer B was 3.52 kg/mm$^2$, and the degree of swelling in toluene 40%. The dried sheet material was sliced into two approximately in the middle of the thickness, the surface was napped by emery buffing, dyed, staked and brushed to give a suede-like sheet material, whose napped surface was composed of fine fibers suggestive of a calf suede, was excellent in luster and writing effect and was judged as resembling a calf suede in feel, flexibility, drapability and recovery from wrinkledness in an organoleptic test where the sheet material was gripped by hands of several persons. The nap strength was sufficient, too.

Observation of the structure of this product revealed that polymer A was present in a nonporous state and localized at the points of crossing of fibers and in the places parallel and close thereto, surrounding and squeezing the fiber bundles, and that polymer B was present in a porous state and localized in the spaces among the fiber bundles without squeezing the fiber bundle. Either of polymer A or polymer B was absent in the space portions resulting from the removal of the sea component. The fiber density in the surface layer of this suede-like material was greater than in the inner part thereof.

EXAMPLE FOR COMPARISON -1

Proceeding as in Example 1 except that the provision of polymer A and the smoothing treatment by a hot roller with an adjusted clearance were omitted, a suede-like sheet material was produced. The nap or fluff of this product was short and had a very low density, and the sheet material was much inferior in calf suede-like writing effect and feeling to the suede-like sheet material of Example 1.

Although application of more severe buffing conditions on this sheet material could improve raisability and produce the same writing effect as in Example 1, such buffing caused extreme decrease in nap strength and no improvement in feeling. There was no fiber density difference between the inner part of the sheet and the surface portion of the substrate.

EXAMPLE 2

The same needle-punched, entangled, nonwoven fabric as in Example 1 was previously treated in a hot air at a temperature of 135° C. so as to fix fibers in contact with one another, and then the surface on both sides was smoothed by bringing both the faces under tension one after another into contact with a cylinder surface maintained at a temperature of 110° C. Thereafter the fabric was impregnated with a 5% solution in DMF of a polyurethane elastomer (polymer A) prepared by reaction of polytetramethylene ether glycol, diphenylmethane-diisocyanate and neopentyl glycol and having a nitrogen content owing to the —NCO group of 4.5%, the elastomer was coagulated in a nonsolvent therefor, and the fiber was dried. The entangled nonwoven fabric so treated contained 106 grams of polymer A per square meter. The fiber was then smoothed on both sides by bringing them under tension one after another into contact with a cylinder surface adjusted at a temperature of 110° C. The resulting fabric showed an apparent density of 0.33 g/cm$^3$. The fabric was then impregnated with the same solution of polymer B as was used in Example 1. After coagulation of polymer B in a nonsolvent therefor, the content of polymer B amounted to about 240 g/m$^2$. The resulting sheet was treated in hot toluene to extract the polyethylene from the fibers so that bundles of fine-denier 6-nylon fibers resulted. A film was separately made of polymer A by a dry coagulation method. The film, on drying, became nonporous, and showed a degree of swelling in toluene of about 65%. The loss on treatment of this film in hot toluene was of negligible order. The initial Young's modulus of this film was 1.05 kg/mm$^2$.

The sheet was then sliced into two in the middle of the thickness, and the original surface was raised by emergy buffing. The length of the nap was a little shorter than in the case of Example 1, namely 0.6 mm on the average. The nap was flexible, and the product like a calf in appearance, touch and feel, and drapability. The surface portion of this suede-like sheet material had a greater fiber density than the inner part thereof had. Polymer A and polymer B were found each in the same state as in the product of Example 1.

EXAMPLE 3

The same entangled nonwoven fabric temporarily fixed after impregnation with polymer A as in Example 1 was impregnated with a 20% aqueous dispersion of an acrylonitrile-butyl acrylate copolymer resin of the self-curing type (polymer B) with a heat sensitizer added. After the amount of polymer B was adjusted to about 370 g/m$^2$, polymer B was coagulated by treatment in hot water at 98° C. The fabric was then impregnated with a 5% aqueous solution of melamine so that the fabric gained melamine in an amount equivalent to 15% of the acrylonitrile-butyl acrylate copolymer resin. The fabric was dried and cured at 140° C. for 10 minutes.

A film of the melamine-cross linked acrylonitrile-butyl acrylate copolymer resin formed by a dry method had an initial Young's modulus of about 12 kg/mm$^2$ and a degree of swelling in toluene of about 45%.

The resin-impregnated, entangled nonwoven fabric was then extracted in hot toluene to remove the matrix component from the fibers. The resulting sheet material was sliced into two approximately in the middle of the thickness thereof, and the surface was raised by emery buffing, dyed, staked and brushed. The suede-like sheet material so produced had a calf-like nap about 0.4 to 0.7 mm long, a very good appearance, a dignified and flexible feel, and a good recoverability from wrinkling.

The surface portion of the sheet substrate showed a higher fiber density than the fiber density of the inner part. Polymer A and polymer B were existing in the same state as in the product of Example 1.

EXAMPLE FOR COMPARISON -2

The entangled nonwoven fabric after impregnation with polymer B in Example 3 was subjected to the same subsequent treatments as in Example 3 but without the melamine treatment. Since polymer A and polymer B were of similar physical properties to each other, including flexibility, the product was inferior in appearance and dignity to the suede-like sheet material produced in Example 3. A film of the untreated (not melamine-treated) polymer B formed by a dry method had an initial Young's modulus of 0.10 kg/mm$^2$.

On the contrary, the melamine treatment in Example 3 prior to the self-curing of polymer B gives a sufficient hardness to the polymer, while the already cured polymer A is not affected by said melamine treatment and therefore the flexibility thereof is hardly impaired, and as a result the effect of the invention can be produced to a great extent.

EXAMPLE 4

A polystyrene-polyethylene terephthalate fiber comprising 50 parts of polystyrene as sea component and 50 parts of polyethylene terephthalate as islet component constituting about 180 fine-denier fibers was drawn to make a 4-denier fiber, which was then crimped and cut. The resulting staple fiber was made into a web weighing 700 grams per square meter by a crosslapping method. The web was needle-punched, and the resulting, entangled nonwoven fabric was so impregnated with a 10% aqueous dispersion of an acrylonitrile-butadiene copolymer (polymer A) that the amount of polymer A contained in the fabric was 80% based on the fiber weight. The fabric was dried at 140° C. The drying also caused curing of polymer A and at the same time temporary fixation of fibers. The fiber was pressed by means of a pair of metallic rolls with a clearance at 80° C. The resulting, temporarily fixed, entangled nonwoven fabric had an apparent density of 0.33 g/cm$^3$, and showed a difference of about 0.06 g/cm$^3$ in apparent density between each surface portion and the inner parts due to difference in resin migration. This density difference was increased by further hot roll pressing with a clearance adjusted, until the surface had an apparent density higher than that of the inner part by about 0.10 g/cm$^3$ and had a greater amount of fibers accordingly.

A polymer A film separately made showed a loss on treatment in perchloroethylene of a negligible order.

The temporarily fixed, entangled nonwoven fabric was impregnated with a composition comprising 70 parts of a 15% solution in DMF of a polyether polyurethane prepared by reaction of polytetramethylene ether glycol with a molecular weight of about 2100, diphenylmethanediisocyanate and ethylene glycol and with a nitrogen content due to the -NCO group of 5%, and 30 parts of a 15% dispersion in DMF of a DMF-insoluble polyurethane emulsion (both the polyurethanes serving as polymer B), treated in a 30% aqueous DMF solution to cause coagulation of polymer B, washed with water and dried, giving a sheet material in which polymer B amounted to about 230 grams per square meter. This sheet material was immersed in perchloroethylene so that the sea componentt of the fiber was removed by extraction.

The resulting sheet material was sliced into two in the middle of the thickness thereof, and the surface was emery-buffed and brushed in water. The product had a tufty, flexible, resilient and high-density nap, and the sheet material as a whole was a flexible and resilient, calf-like one.

The surface fiber density of the substrate of this suede-like sheet material was higher than the fiber density of the inner part of the substrate. Polymer A and polymer B were in the same state as in the product of Example 1.

What is claimed is:

1. A suede-like sheet material comprising:

(a) a fibrous mat comprising bundles of fine-denier fibers and void spaces prepared by removing the sea component of an oceano-insular composite fiber by extraction with a solvent or by decomposition with a decomposing agent, said fine-denier fibers not being greater than 0.3 denier;

(b) a first polymer, polymer A, localized in tthe sheet material primarily at and around juxtaposed areas of adjacent fiber bundles to adhere them together, polymer A being an elastomer with a degree of swelling in said solvent or decomposing agent at a temperature of 30° C. of not less than 30% by weight and an initial Young's modulus as measured in the form of a non-porous film of not more than 10 kg/mm$^2$; and (c) a second polymer, polymer B, being present primarily surrounding polymer A in the spaces among the fiber bundles, polymer B being an elastomer with a degree of swelling not more than two-thirds of that of polymer A and an initial Young's modulus as measured in the form of a non-porous film greater than that of polymer A by at least 0.2 kg/mm$^2$;

wherein the space portions in the fiber bundles are substantially free from polymer A and polymer B; and wherein the suede-like material has a nap resulting from said fine-denier fibers on at least one side.

2. A suede-like sheet material as claimed in claim 1, wherein said substrate has a higher fiber density in the surface portion or layer thereof than in the inner part thereof.

3. A suede-like sheet material as claimed in claim 1, wherein said polymer A is an elastomer, the loss of said elastomer caused by said solvent or decomposing agent at the time of removel of said sea component being not more than 20% by weight.

4. A suede-like sheet material as claimed in claim 1, wherein the apparent density of said polymer A is not less than 0.60 g/cm$^3$.

5. A suede-like sheet material as claimed in claim 1, wherein said polymer A is a substantially nonporous polymer.

6. A suede-like sheet material as claimed in claim 1, wherein said degree of swelling of polymer B is not more than 100% by weight.

7. A suede-like sheet material as claimed in claim 1, wherein said polymer B is a porous polymer.

8. A method of producing a suede-like sheet material having characteristics of a suede leather together with a napping resulting from bundles of a large number of fine-denier fibers on the surface of the substrate sheet comprising a fibrous mat impregnated with two elastomeric polymers, polymer A and polymer B, which method comprises:

(a) providing a fibrous mat mainly composed of oceano-insular composite fibers comprising at least two polymeric materials different in properties from each other, at least one of said polymeric materials being present in said fibers as a sea component forming a matrix for at least one other polymeric material which is dispersed as a plurality of fine-denier fibers in the sea component and appears, when viewed sectionally, as islets in the sea component, said fine-denier fibers not being greater than 0.3 denier;

(b) prior to impregnating said fibrous mat with elastomeric polymer B, subjecting at least one surface of the mat to sufficient heat and pressure to smooth the surface;

(c) impregnating said fibrous mat with polymer A and solidifying polymer A;

(d) impregnating said fibrous mat with polymer B and solidifying polymer B;

(e) at least partially removing the sea component of the composite fibers by dissolving or decomposing the sea component to form a bundle of fine-denier fibers from each oceano-insular composite fiber, wherein siad polymer A is an elastomer with a degree of swelling at a temperature of 30° C. in the solvent or decomposing agent for removing said sea component of not less than 30% by weight and an initial Young's modulus as measured in the form of a non-porous film of not more than 10 kg/mm$^2$ and said polymer B is an elastomer with a degree of said swelling not more than two thirds of that of polymer A and an initial Young's modulus as measured in the form of a non-porous film greater than that of polymer A by at least 0.2 kg/mm$^2$; and (f) napping at least one surface of the sheet material.

9. A method as claimed in claim 8, wherein the fineness of the fine-denier fibers is not moe than 0.3 denier.

10. A method as claimed in claim 8, wherein said polymer A is an elastomer with a degree of swelling at a temperature of 30° C. in said solvent or decomposing agent for removing said sea component of not less than 30% by weight and an initial Young's modulus as measured in the form of a non-porous film of not more than 10 kg/mm$^2$ and said polymer B is an elastomer with a degree of said swelling not more than two thirds of that of polymer A and an initial Young's moduius as measured in the form of a non-porous film greater than that of polymer A by at least 0.2 kg/mm$^2$.

11. A method as claimed in claim 8, wherein said polymer A is an elastomer, the loss of said elastomer caused by said solvent or decomposing agent at the time of removal of said sea component being not more than 20% by weight.

12. A method as claimed in claim 8, wherein said degree of swelling of polymer B is not more than 100% by weight.

13. A method as claimed in claim 8, wherein the surface of the sheet material is napped to the depth of not more than 0.2 mm.

14. A method as claimed in claim 8 wherein the step of subjecting at least one surface of the mat to sufficient heat and pressure to smooth the surface is conducted prior to impregnating the mat with polymer A.

15. A method as claimed in claim 8 wherein the step of subjecting at least one surface of the mat to sufficient heat and pressure to smooth the surface is conducted subsequent to impregnating with polymer A.

16. A method as claimed in claim 8 wherein the mat is temporarily fixed witth a sizing agent prior to impregnation with polymer A, and the sizing agent is removed after impregnation with polymer B.

17. A method as claimed in claim 8 wherein the mat is temporarily fixed with a sizing agent after impregnation with polymer A, and the sizing agent is removed after impregnation with polymer B.

* * * * *